US007595627B1

(12) United States Patent
Mahnke et al.

(10) Patent No.: US 7,595,627 B1
(45) Date of Patent: Sep. 29, 2009

(54) VOLTAGE REFERENCE CIRCUIT WITH COMPLEMENTARY PTAT VOLTAGE GENERATORS AND METHOD

(75) Inventors: Torsten Mahnke, Munich (DE); Stephan Drebinger, Munich (DE); Michael Brauer, Starnberg (DE)

(73) Assignee: National Semiconductor Corporation, Santa Clara, CA (US)

( * ) Notice: Subject to any disclaimer, the term of this patent is extended or adjusted under 35 U.S.C. 154(b) by 188 days.

(21) Appl. No.: 11/900,993

(22) Filed: Sep. 14, 2007

(51) Int. Cl.
*G05F 3/16* (2006.01)

(52) U.S. Cl. ..... 323/316; 323/315

(58) Field of Classification Search ..... 323/314, 323/315, 316

See application file for complete search history.

(56) References Cited

U.S. PATENT DOCUMENTS 4,636,710 A 1/1987 Stanojevic
6,288,525 B1 9/2001 Fischer
6,507,179 B1 1/2003 Jun et al.
6,614,209 B1 9/2003 Gregoire, Jr.
6,765,431 B1 7/2004 Coady
6,774,711 B2 * 8/2004 Bernard ..... 327/539
7,279,978 B2 * 10/2007 Scuderi et al. ..... 330/285

OTHER PUBLICATIONS

Keith E. Sanborn, et al., "A Sub-1 V Low-Noise Bandgap Voltage Reference," IEEE 2006 Custom Integrated Circuits Conference (CICC), pp. 607-610.
Christian Falconi, et al., "Low-Voltage CMOS Current and Voltage References without Resistors," IEEE 2007, pp. 1907-1910.
E.M. Cherry, "2-Terminal floating bandgap reference," IEE Proc.-Circuits Devices Syst., vol. 152, No. 6, Dec. 2005, pp. 729-734.

* cited by examiner

*Primary Examiner*—Shawn Riley

(57) ABSTRACT

A voltage reference circuit is provided. The voltage reference circuit includes a first PTAT voltage generator and an amplifier. The first PTAT voltage generator is operable to generate a first PTAT voltage. The amplifier, which is coupled to the first PTAT voltage generator, comprises a second PTAT voltage generator that is complementary to the first PTAT voltage generator. The second PTAT voltage generator is operable to generate a second PTAT voltage. The amplifier is operable to generate a reference voltage based on the first PTAT voltage and the second PTAT voltage.

20 Claims, 6 Drawing Sheets

| FIG. 4A | FIG. 4B | FIG. 4C |
|---|---|---|

VOLTAGE REFERENCE CIRCUIT WITH COMPLEMENTARY PTAT VOLTAGE GENERATORS AND METHOD

TECHNICAL FIELD

This disclosure is generally directed to voltage reference circuits and, more specifically, to a voltage reference circuit with complementary PTAT voltage generators.

BACKGROUND

The rapid proliferation of local area network (LANs) in the corporate environment and the increased demand for time-sensitive delivery of messages and data between users has spurred development of high-speed (gigabit) Ethernet LANs. The 100BASE-TX Ethernet LANs using category-5 (CAT-5) copper wire and the 1000BASE-T Ethernet LANs capable of one gigabit per second (1 Gbps) data rates over CAT-5 data grade wire use new techniques for the transfer of high-speed data symbols.

Conventional 1000BASE-T Ethernet LAN drivers, in addition to nearly all other signal processing/communication chips and systems, use voltage reference circuits. These voltage reference circuits are able to generate relatively constant reference voltages that have a well-defined magnitude, as well as minimal process variation, temperature variation, and voltage variation.

However, conventional CMOS-based band-gap voltage reference circuits are highly prone to variations as a result of noise, power supply rejection problems, and other accuracy issues. In addition, voltage reference circuits preferably should be capable of operating at relatively low voltages with minimal current consumption, which provides yet another design challenge.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the term "each" means every one of at least a subset of the identified items; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior as well as future uses of such defined words and phrases.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 6, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged reference circuit.

Figure 1:
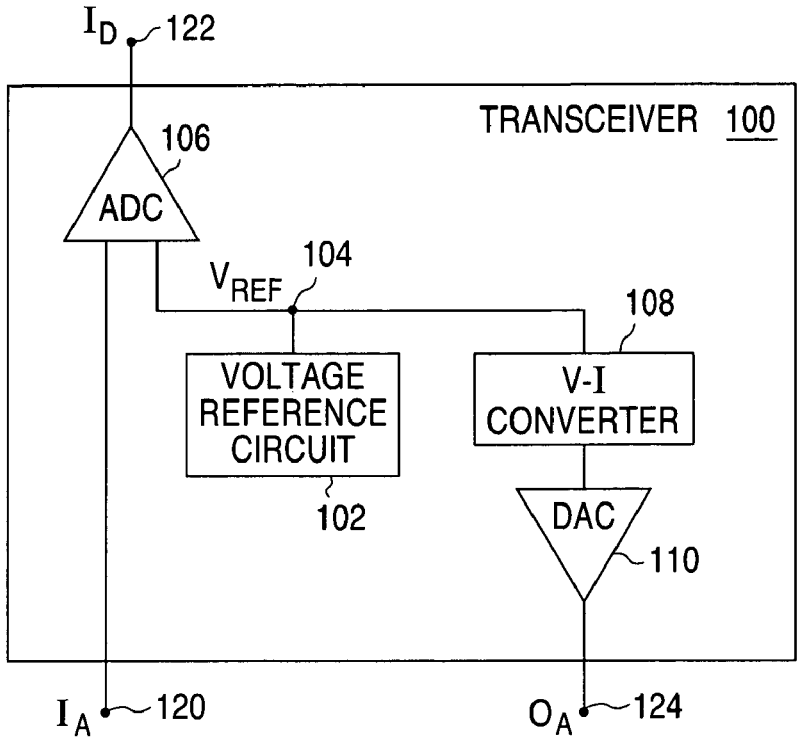
FIG. 1 is a block diagram illustrating a transceiver including a voltage reference circuit with complementary PTAT voltage generators in accordance with one embodiment of the present disclosure.

FIG. 1 is a block diagram illustrating a transceiver 100 in accordance with one embodiment of the present disclosure. According to one embodiment, the transceiver 100 comprises a gigabit Ethernet transceiver. However, it will be understood that the transceiver 100 may comprise any suitable transceiver operable to receive and transmit data.

The transceiver 100 comprises a voltage reference circuit 102 that is operable to generate a reference voltage 104 for the transceiver 100. As described in more detail below, the voltage reference circuit 102 is operable to generate the reference voltage 104 using two complementary proportional-to-absolute-temperature (PTAT) voltage generators, which improves accuracy and reduces noise as compared to a reference voltage generated using a single PTAT voltage generator. However, one of the two PTAT voltages is generated by an existing differential error amplifier. Because of this, an additional device is not needed to generate the complementary PTAT voltage and current consumption is not increased as compared to a voltage reference circuit that generates a reference voltage using a single PTAT voltage generator.

According to one embodiment, the voltage reference circuit 102 of the transceiver 100 combines a pair of PNP transistors with a pair of NPN transistors in order to form a low-voltage double-$\Delta V_{BE}$ topology for high precision and low noise. The NPN transistors also operate as an input differential stage to a low-voltage folded-cascode error amplifier, which reduces the circuit complexity and current consumption, as previously described. In addition, a high power supply rejection ratio (PSRR) may be obtained by means of a fully-cascoded ground-referred architecture and by deriving critical digital control signals from the reference voltage 104.

The transceiver 100 also comprises an analog-to-digital converter (ADC) 106, a voltage-to-current (V-I) converter 108, and a digital-to-analog converter (DAC) 110, in addition to any other suitable circuitry. The ADC 106, which is coupled to the voltage reference circuit 102, is operable to receive an analog input signal ($I_A$) 120 and the reference voltage 104 and to generate a digital input signal ($I_D$) 122 based on the analog input signal 120 and the reference voltage 104.

The V-I converter 108, which is also coupled to the voltage reference circuit 102, is operable to receive the reference voltage 104 and to convert the reference voltage 104 into a specified current based on the reference voltage 104. The DAC 110 is coupled to the V-I converter 108 and is operable to transmit an analog output signal ($O_A$) 124 based on the specified current from the V-I converter 108.

In operation, for one embodiment, the voltage reference circuit 102 generates the reference voltage 104 and provides the reference voltage 104 to both the ADC 106 and the V-I converter 108. The ADC 106 may also receive an analog input signal 120 and may convert that signal 120 into a digital input signal 122 based on the reference voltage 104. The V-I converter 108 converts the reference voltage 104 into a specified current and provides the specified current to the DAC 110. The DAC 110 may generate an analog output signal 124 based on the specified current and transmit the analog output signal 124 from the transceiver 100 to any other suitable component.

Figure 2:
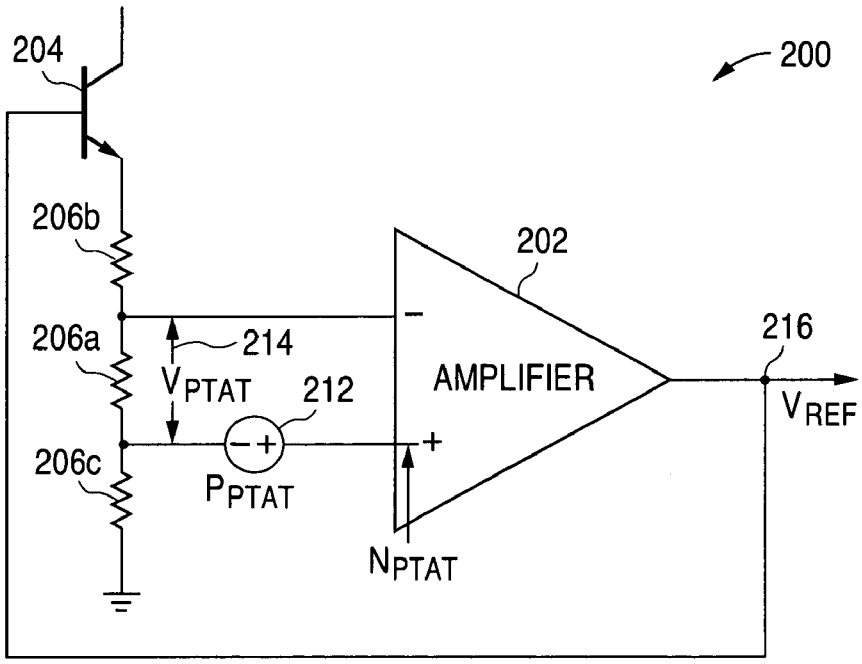
FIG. 2 illustrates the voltage reference circuit of FIG. 1 in accordance with one embodiment of the present disclosure.

FIG. 2 illustrates a voltage reference circuit 200 in accordance with one embodiment of the present disclosure. It will be understood that, in addition to being included in the transceiver 100 as the voltage reference circuit 102, the voltage reference circuit 200 may be included in any other suitable component with a use for a relatively constant reference voltage without departing from the scope of the present disclosure.

The voltage reference circuit 200 comprises an amplifier 202, an input transistor 204, a resistive network 206, and a voltage source 212. The amplifier 202, which may comprise an operational transconductance amplifier or other suitable type of amplifier, is operable to generate a reference voltage 216 based on complementary PTAT voltages. The voltage source 212 is operable to provide a first PTAT voltage, $P_{PTAT}$, while the second PTAT voltage, $N_{PTAT}$, is generated within the amplifier 202. The reference voltage 216 is generated at the base of the input transistor 204 based on the combination of the two PTAT voltages. Thus, a PTAT voltage 214, which is the voltage across the resistor 206*a*, may be defined as follows:

$$V_{PTAT}=P_{PTAT}+N_{PTAT}.$$

In operation, for one embodiment, the voltage source 212, which comprises a first PTAT voltage generator made up of a pair of PNP transistors, generates a first PTAT voltage. The voltage source 212 then provides that first PTAT voltage to the amplifier 202, which comprises a second PTAT voltage generator made up of a pair of NPN transistors. The second PTAT voltage generator generates a second PTAT voltage. The amplifier 202 then generates the reference voltage 216 based on the first PTAT voltage and the second PTAT voltage.

Figure 3:
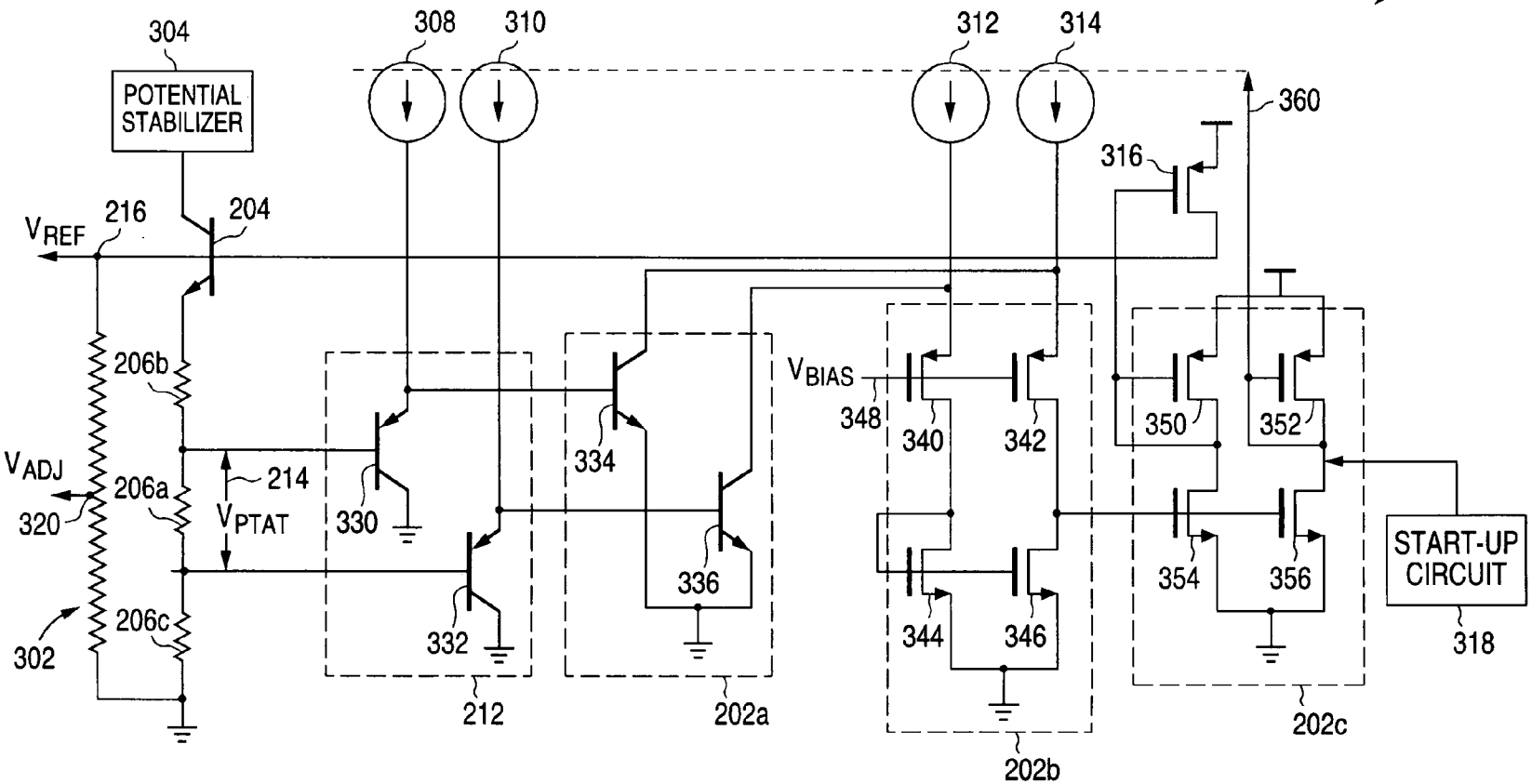
FIG. 3 illustrates details of the voltage reference circuit of FIG. 2 in accordance with one embodiment of the present disclosure.

FIG. 3 illustrates details of the voltage reference circuit 200 in accordance with one embodiment of the present disclosure. For this embodiment, the voltage reference circuit 200 comprises a resistive divider 302, a potential stabilizer 304, a plurality of current sources 308, 310, 312 and 314, a transistor 316 and a start-up circuit 318, in addition to the amplifier 202, input transistor 204, resistive network 206 and voltage source 212.

The resistive divider 302 is coupled to the input transistor 204 and is operable to generate an adjustable voltage 320 based on the reference voltage 216. For example, for a particular embodiment, the reference voltage 216 may be about 1.2 V and the resistive divider 302 may comprise about 2.4 MΩ. For this embodiment, the resistive divider 302 may have about twenty taps around the 500 mV level in order to provide an adjustable, temperature-compensated 500 mV output for the adjustable voltage 320. For example, twenty 3-kΩ resistors may be coupled in series with taps between them. Using a bias current of 500 nA, the adjustable voltage 320 may be adjusted in 1.5-mV increments.

The potential stabilizer 304 is coupled to the input transistor 204. The potential stabilizer 304 is operable to stabilize the potential at the collector of the input transistor 204. For example, the potential stabilizer 304 may comprise a parallel cascode device and a current source, a voltage regulator, or any other suitable device capable of stabilizing the potential at the collector of the input transistor 204.

The voltage source 212 comprises a level shifter made up of two PNP transistors 330 and 332. The amplifier 202 comprises a differential amplifier 202*a* made up of two NPN transistors 334 and 336, a folded-cascode stage 202*b* made up of two PMOS transistors 340 and 342 and two NMOS transistors 344 and 346, and a diode-load gain stage 202*c* made up of two PMOS transistors 350 and 352 and two NMOS transistors 354 and 356.

The level-shifting voltage source 212 is operable to generate a first PTAT voltage ($P_{PTAT}$), and the differential amplifier 202*a* is operable to generate a second PTAT voltage ($N_{PTAT}$). Thus, the level-shifting voltage source 212 comprises a PTAT voltage generator, while the differential amplifier 202*a* comprises a complementary PTAT voltage generator with respect to the voltage source 212.

The PTAT voltage 214, which appears across the resistor 206*a*, is determined by the sum of the two PTAT voltages ($P_{PTAT}$ and $N_{PTAT}$), which are actually two $\Delta V_{BE}$ terms. The first term is the $\Delta V_{BE}$ of the PNP transistors 330 and 332, while the second term is the $\Delta V_{BE}$ of the NPN transistors 334 and 336. For one embodiment, transistor 332 is operated at 16 times the current density of transistor 330, and transistor 334 is operated at eight times the current density of transistor 336. For this embodiment, the PTAT voltage 214 ($V_{PTAT}$) may be calculated as follows:

$$V_{R206a} = V_{PTAT} = V_{BE330} + V_{BE334} + V_{EB336} + V_{EB332} = V_{BE330} - V_{BE332} + V_{BE334} - V_{BE3336} = V_{TH} \cdot \ln(16) + V_{TH} \cdot \ln(8) = V_{TH} \cdot \ln(128),$$

where $V_{TH}$ is the thermal voltage (i.e., kT/q). Therefore, at room temperature, the PTAT voltage 214 for this embodiment is approximately 126 mV.

For one embodiment, the resistive network 206 may comprise three polysilicon resistors 206*a*, 206*b* and 206*c*, each of which may comprise a number of unity devices. For example, the unity devices may comprise 18-kΩ resistors. The resistor 206*a* and the PTAT voltage 214 define the bias current in the resistive network 206. Thus, with 126 mV at 126 kΩ, the current through the resistors 206*a-c* and the input transistor 204 would be 1 μA under nominal conditions.

The resistors 206*b* and 206*c* may be of essentially equal size in order to cancel the effects of the base currents of transistors 330 and 332. This results from the following equation provided that the two base currents are equal:

$$\begin{aligned} V_{REF} = {} & V_{BE204} + (I_{R206a} - I_{B332})R_{206c} + I_{R206a}R_{206a} + (I_{R206a} + I_{B330})R_{206b} = \\ & V_{BE204} + I_{R206a}(R_{206a} + R_{206b} + R_{206c}) + I_{B330}R_{206b} - I_{B332}R_{206c} = \\ & V_{BE204} + V_{PTAT}(1 + (R_{206b} + R_{206c})/R_{206a})) + \\ & I_{B330}R_{206b} - I_{B332}R_{206c} \end{aligned}$$

In order to achieve a temperature-compensated reference voltage 214 under nominal operating conditions, resistors 206*b* and 206*c* may each comprise a nominal value of 208 kΩ for a particular embodiment.

For one embodiment, resistor 206*c* may be made programmable to allow post-production trimming of the temperature coefficient. For a particular embodiment, resistor 206*c* may be programmable from 184 kΩ to 231.25 kΩ in steps of 0.75 kΩ, which translates to a PTAT voltage adjustment resolution of 0.75 mV at the nominal current of 1 μA. For this particular embodiment, the programmable section of resistor 206*c* may be binary weighted, i.e., a series connection of six blocks from 0.75 kΩ to 24 kΩ ($2^n$×0.75 kΩ, with n=0, 1, 2, 3, 4, 5) connected in series. Each block may be shorted by an NMOS pass transistor (50 μm/0.5 μm).

For one embodiment, a bias voltage 348 for the folded-cascode stage 202*b* comprises a PTAT voltage, which partially compensates for the cascode device's gate-source voltage variation with temperature. The biasing of the voltage reference circuit 200 is self-regulating. The reference current level is defined by the reference voltage 216 and the total resistance between the output node providing the reference voltage 216 and ground. With 1.2 V at 2.4 MΩ, the current would be 500 nA.

A common mode feedback 360 is provided from the diode-load gain stage 202*c* to the current sources 308, 310, 312 and 314 in order to provide a self-biasing feedback loop. This self-biasing feedback loop, along with an output voltage regulation feedback loop provided by the application of the reference voltage 216 to the base of the input transistor 204, allows optimization of accuracy and the use of a low supply voltage simultaneously. The accuracy may be primarily determined by the precision of the self-biasing current sources 308, 310, 312 and 314, while the low supply voltage may be potentially limited by the $V_{D,SAT}$ of the transistor 316, which feeds the resistive divider 302.

Figure 4A:
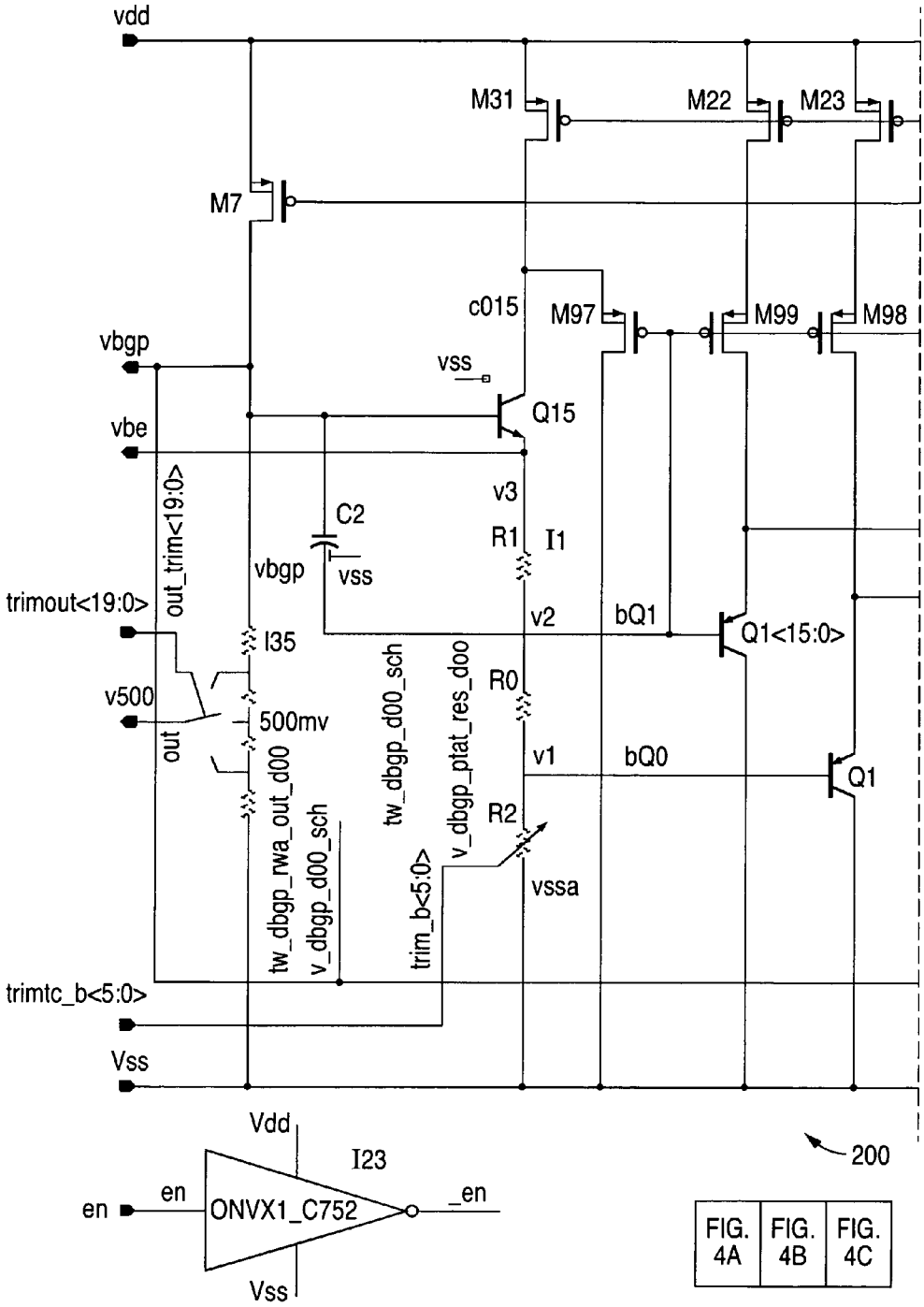
FIG. 4 illustrates the voltage reference circuit of FIG. 3 in greater detail in accordance with one particular embodiment of the present disclosure.
Figure 4B:
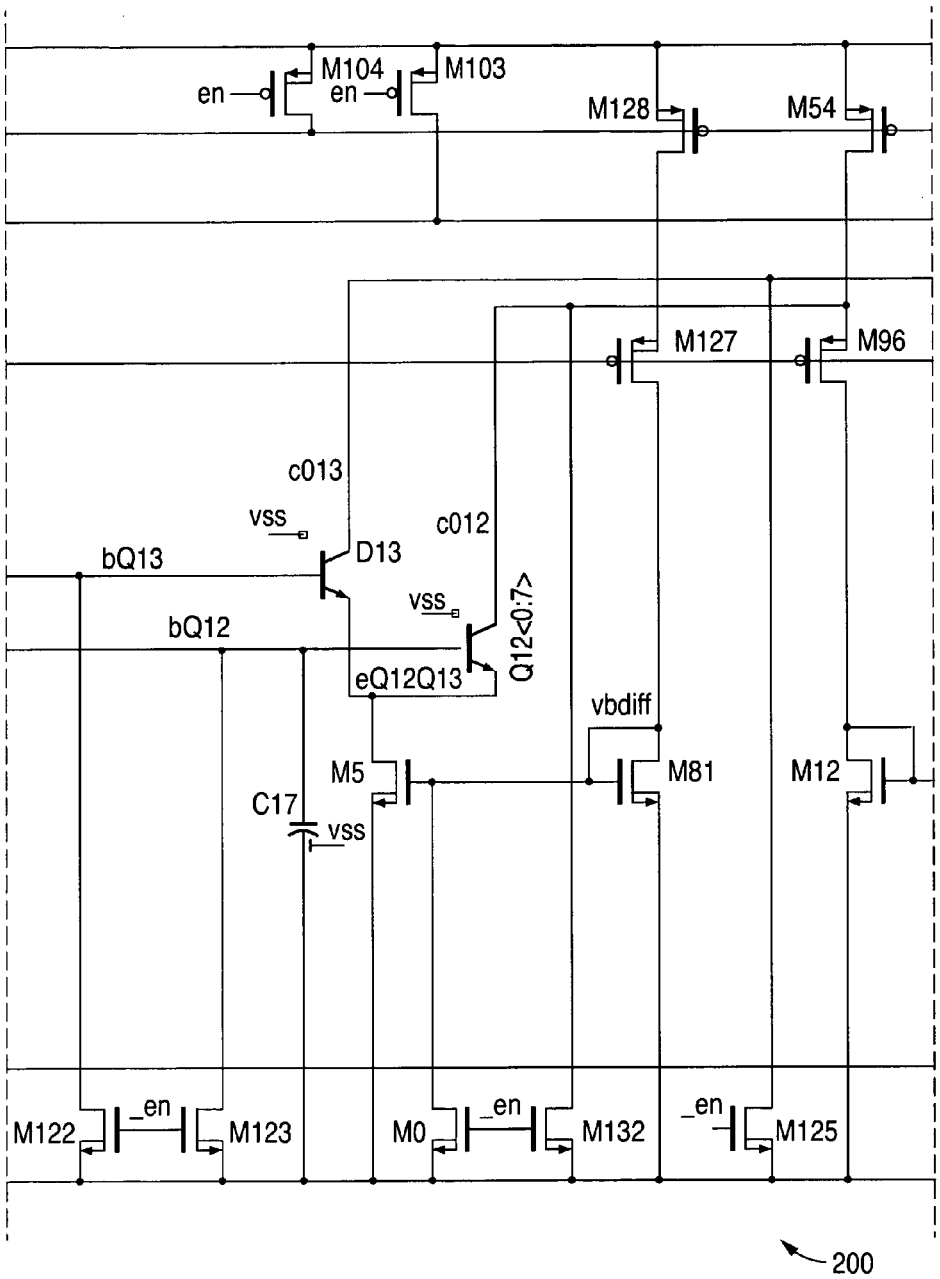
Figure 4C:
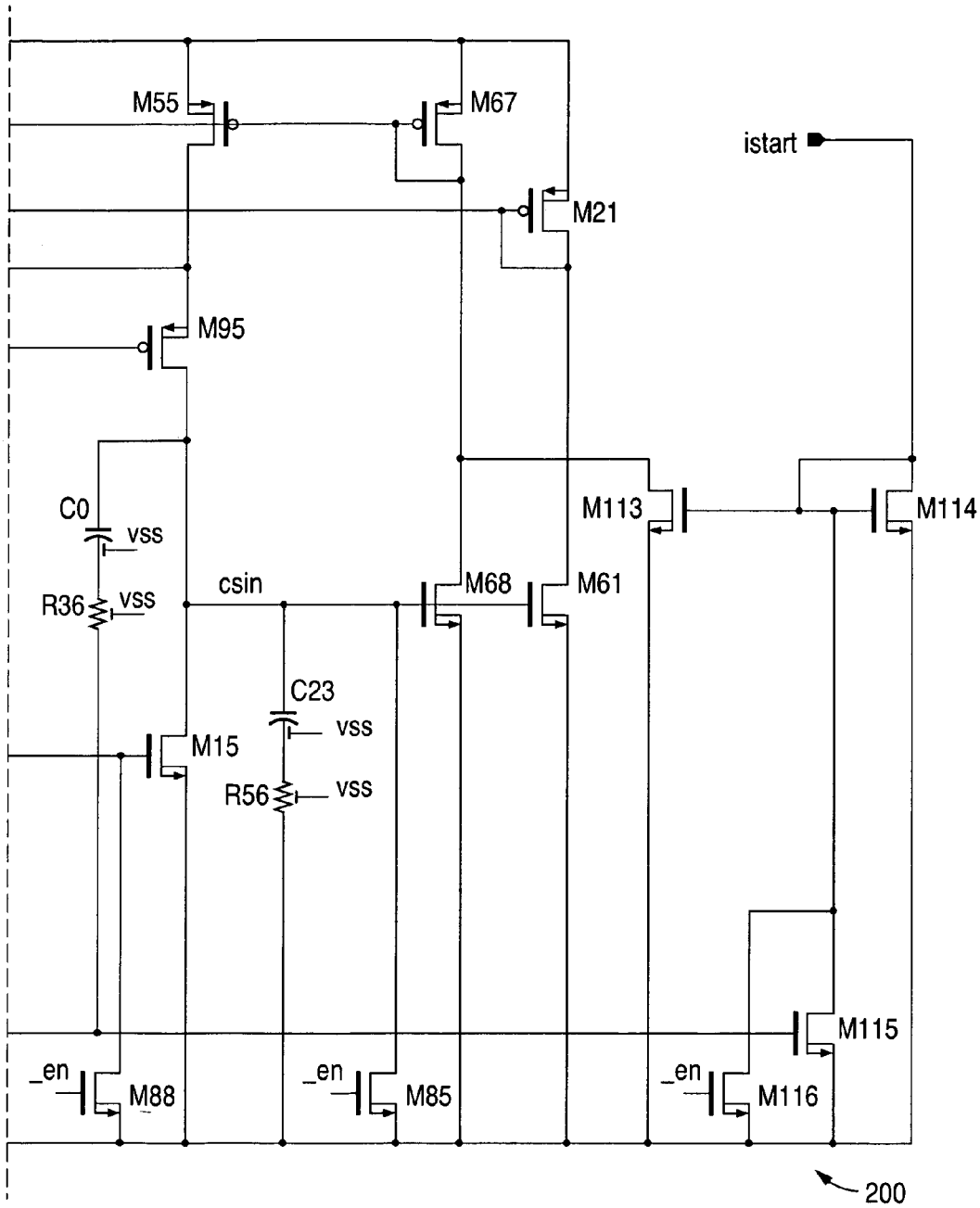

FIG. 4 illustrates the voltage reference circuit 200 as shown in FIG. 3 in even greater detail in accordance with one particular embodiment of the present disclosure. For this embodiment, the resistors 206*a*, 206*b* and 206*c* are labeled as R0, R1 and R2, respectively. The input transistor 204 is labeled as Q15. The reference voltage 216 is labeled as vbgp. The potential stabilizer 304 is provided by the current source M31 and the parallel cascode device M97. The current sources 308, 310, 312 and 314 are labeled as M22, M23, M54 and M55, respectively. The transistor 316 is labeled as M7. The transistors 330, 332, 334 and 336 are labeled as Q1, Q0, Q13 and Q12, respectively. The transistors 340, 342, 344 and 346 are labeled as M96, M95, M12 and M15, respectively. The transistors 350, 352, 354 and 356 are labeled as M21, M67, M68 and M61, respectively. The start-up circuit 318 is provided by M104, M103, M122, M123, M0, M132, M125, M88, M85, M113, M114, M115 and M116. For one embodiment, the start-up circuit 318 may use an externally-generated supply-voltage-independent current of a few hundred nanoamps. For example, for a particular embodiment, the current may vary with temperature but remain within a range of about 100 to 300 nA.

The circuit 200 illustrated in FIG. 4 is based on a pair of substrate PNP transistors Q0 and Q1 (available in standard CMOS technology) operating at different current densities, a resistive network R0, R1 and R2, and a vertical NPN transistor Q15 (available in triple-well CMOS technology) that are arranged in a bandgap reference circuit configuration. The circuit 200 of FIG. 4 is further based on a low-voltage folded-cascode differential error amplifier with vertical-NPN input stage. These NPN devices Q12 and Q13 also operate at different current densities, thereby forming with the PNP transistor pair Q0 and Q1 a double-$\Delta V_{BE}$ architecture. This improves accuracy and noise while retaining low-voltage capability without adding devices or increasing current consumption. In addition, high PSRR is provided by means of a fully-cascoded ground-referred architecture that exploits conventional cascode devices, as well as a PTAT-voltage-controlled parallel cascode device. The PSRR is further improved by deriving the logical high level of certain digital control signals from the reference voltage 216 instead of from the positive power supply. Finally, for the embodiment of FIG. 4, the following transistor pairs are mathed: Q1 and Q0, Q13 and Q12, M22 and M23, MS4 and MS5, M12 and M15, and M68 and M61 (which are also matched to M12 and M15).

The potential (csin) at the input of the common source stages is derived from the nominal current in the output branch via the current mirror M7/M21 and the common source device M61. A copy of the current through M61/M21 is created in the second common source stage M68/M67. This current is mirrored into all remaining branches biased by PMOS current sources. Through the NMOS current mirror M81/M5, the current is also used to bias the differential pair. Thus, for this embodiment, all bias currents are derived from the regulated reference current in the output branch.

The voltage reference circuit 200 of FIG. 4 has been optimized for high PSRR. Thus, the circuit 200 has a ground-referred architecture and substantially perfect symmetry. All relevant node voltages in the circuit 200 are referred to ground as a result of the folded-cascode differential stage and the additional cascode devices M97, M98, M99 and M127.

The low-frequency PSRR, which is in fact the line regulation, would depend largely on the Early voltage of Q15 if the parallel cascode device M97 (and the current source M31) were not present. Any variation of the positive supply voltage would modulate the collector-emitter voltage of Q15, which at a constant collector current would change its base-emitter voltage and, hence, the reference voltage 216. The parallel cascode device M97 acts to keep the collector of Q15 at a fixed potential, essentially eliminating the impact of the Early effect on the PSRR.

The current source M31 decouples the collector of Q15 from the supply and provides the bias current for M97. The gate of M97 is controlled by a PTAT bias voltage, which partially compensates for the complementary-to-absolute-temperature (CTAT) characteristic of the gate-source voltage of M97. Without this compensation, the temperature coefficient at the source node of M97 would be too large to ensure both the NPN device Q15 and the current source M31 would operate in the proper region under all possible operating conditions.

For symmetry, the PMOS current sources M22 and M23 are matched. Besides matching of the device structures, this also means that the drain-source voltages are to be the same, which is a condition provided by the cascode transistors. This also holds for the current sources M54 and M55. The NMOS current mirror M12/M15, which acts as a load in the folded-cascode differential stage, has a same drain-source voltage for the two transistors. These voltages are kept equal by proper matching with the common source devices M68 and M61.

Also for high PSRR, the signals controlling the temperature-compensated (TC) trimming are decoupled from supply variations. Thus, for this embodiment, the preceding driver stage may be coupled to the reference voltage 216 instead of to the positive supply, $V_{DD}$. In addition, the high-frequency PSRR may be even further improved by providing RC filtering at the output node providing the reference voltage 216.

For the illustrated embodiment, the dominant high-impedance node in the circuit 200 is the input of the common source stages. The capacitance at this node can be expected to create the dominant pole. However, if a large capacitance were present at the drain of M61, additional poles and zeroes would appear at relatively low frequencies, making frequency compensation difficult or impossible. Thus, for this reason the common source stage is duplicated in the circuit 200. Separating the regulating and biasing common source stages minimizes the capacitance at the drain node of M61 at the cost of 250 nA additional bias current for the embodiment described above.

Sufficient phase and gain margins are achieved by means of a feedforward capacitor coupled between the reference voltage 216 and the base of Q1 and an RC network coupled between the reference voltage 216 and the input of the common source stages M61/M68. A small capacitor from the base of Q12 to ground also helps to improve the margins.

As described above, the circuit 200 is operable to provide low-voltage operation. For a particular embodiment, the circuit 200 is specified to operate at supply voltages down to 1.6 V. The folded-cascode differential stage is one element that enables this low-voltage operation. Another feature is the way the PTAT voltage 214 is generated based on both NPN and PNP transistors. Unlike other double-$\Delta V_{BE}$ approaches, this circuit 200 does not use stacked base-emitter diodes and, thus, does not restrict low-voltage operation.

Figure 5:
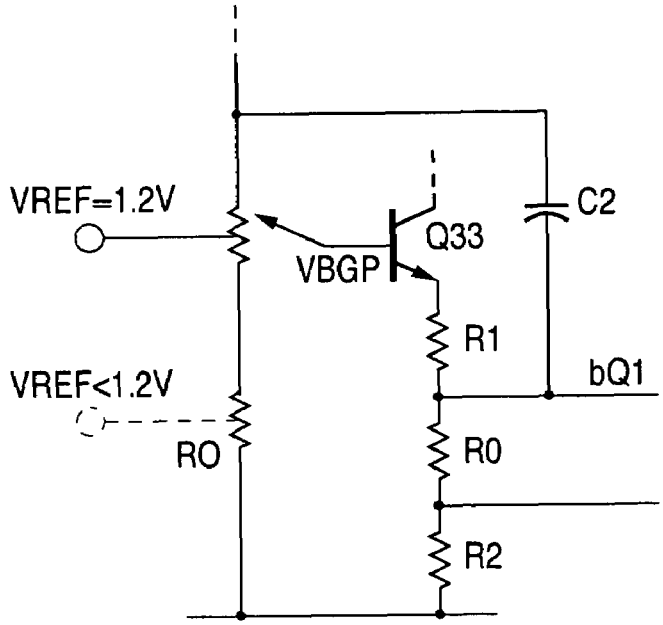
FIG. 5 illustrates a portion of the voltage reference circuit of FIG. 4 with post-production trimming provided in accordance with an alternate embodiment of the present disclosure.

FIG. 5 illustrates a portion of the voltage reference circuit 200 of FIG. 4 with post-production trimming provided in accordance with an alternate embodiment of the present disclosure. For this embodiment, the trimming is performed at the base of the NPN device Q15 regardless of the voltage level provided by the reference voltage 216. The resistive divider 302 comprises a plurality of taps at the bandgap voltage level, where analog switches (e.g., pass transistors, transmission gates or other suitable devices) may couple the base of the device Q15 to any of the taps.

Figure 6:
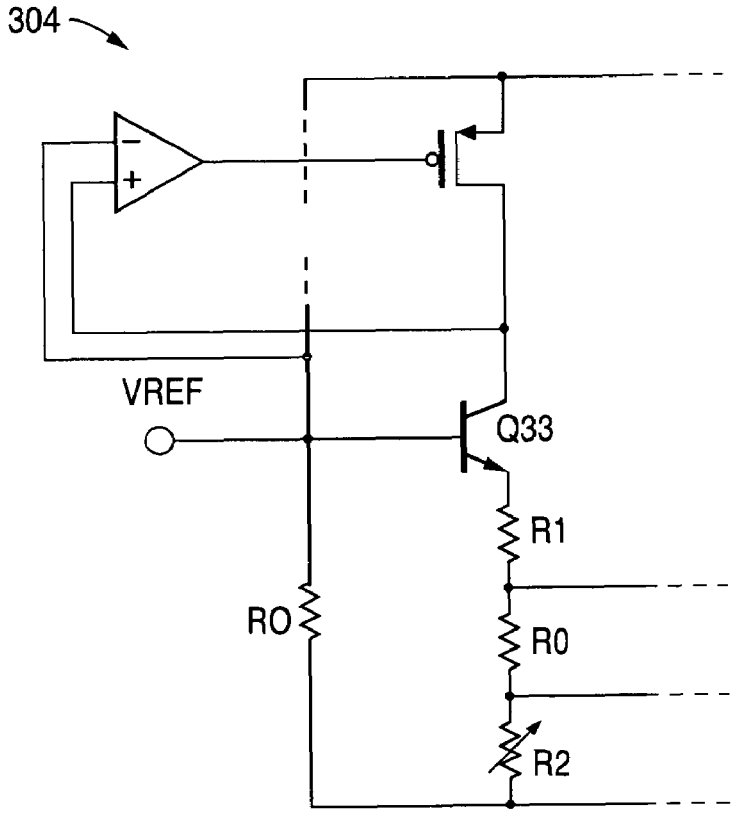
FIG. 6 illustrates a portion of the voltage reference circuit of FIG. 4 with the potential stabilizer provided in accordance with an alternate embodiment of the present disclosure.

FIG. 6 illustrates a portion of the voltage reference circuit 200 of FIG. 4 with the potential stabilizer 304 provided in accordance with an alternate embodiment of the present disclosure. For this embodiment, the potential stabilizer 304 comprises a linear voltage regulator.

Although the present disclosure has been described with an exemplary embodiment, various changes and modifications may be suggested to one skilled in the art. For example, although the embodiments described above refer to PNP transistors and NPN transistors in a particular arrangement, it will be understood that a complementary topology implementing NPN transistors instead of PNP transistors and vice versa, along with any suitable accompanying alterations, may be used without departing from the scope of the present disclosure. It is intended that the present disclosure encompass such changes and modifications as fall within the scope of the appended claims.

What is claimed is:

1. A voltage reference circuit, comprising:

a first PTAT voltage generator operable to generate a first PTAT voltage; and an amplifier coupled to the first PTAT voltage generator, the amplifier comprising a second PTAT voltage generator complementary to the first PTAT voltage generator, the second PTAT voltage generator operable to generate a second PTAT voltage, and the amplifier operable to generate a reference voltage based on the first PTAT voltage and the second PTAT voltage.

2. The voltage reference circuit of claim 1, further comprising:

an input transistor; and a resistive network coupled to the input transistor and to the first PTAT voltage generator.

3. The voltage reference circuit of claim 2, the input transistor coupled to the amplifier and operable to receive the reference voltage.

4. The voltage reference circuit of claim 2, further comprising a potential stabilizer coupled to a collector of the input transistor, the potential stabilizer operable to stabilize a potential at the collector of the input transistor.

5. The voltage reference circuit of claim 2, the resistive network comprising a first resistor, a second resistor and a third resistor coupled in series, the first PTAT voltage generator coupled to a first node of the first resistor and to a second node of the first resistor.

6. The voltage reference circuit of claim 1, the first PTAT voltage generator comprising a pair of PNP transistors and the second PTAT voltage generator comprising a pair of NPN transistors.

7. The voltage reference circuit of claim 6, the pair of PNP transistors capable of operating at different current densities and the pair of NPN transistors capable of operating at different current densities.

8. The voltage reference circuit of claim 1, the first PTAT voltage generator comprising a pair of NPN transistors and the second PTAT voltage generator comprising a pair of PNP transistors.

9. The voltage reference circuit of claim 8, the pair of NPN transistors capable of operating at different current densities and the pair of PNP transistors capable of operating at different current densities.

10. The voltage reference circuit of claim 1, the reference voltage operable to provide a logical high level for a plurality of digital control signals for use in the voltage reference circuit.

11. A voltage reference circuit, comprising:

a first PTAT voltage generator operable to generate a first PTAT voltage; and an amplifier coupled to the first PTAT voltage generator, the amplifier comprising a differential amplifier, a folded-cascode stage, and a diode-load gain stage, the differential amplifier comprising a second PTAT voltage generator complementary to the first PTAT voltage generator, the differential amplifier operable to generate a second PTAT voltage, and the amplifier operable to generate a reference voltage based on the first PTAT voltage and the second PTAT voltage.

12. The voltage reference circuit of claim 11, the first PTAT voltage generator comprising a level shifter, the level shifter comprising a pair of PNP transistors.

13. The voltage reference circuit of claim 11, the differential amplifier comprising a pair of NPN transistors.

14. The voltage reference circuit of claim 11, the folded-cascode stage comprising a pair of PMOS transistors and a pair of NMOS transistors.

15. The voltage reference circuit of claim 11, the diode-load gain stage comprising a pair of PMOS transistors a pair of NMOS transistors.

16. The voltage reference circuit of claim 11, further comprising:

an input transistor coupled to the amplifier and operable to receive the reference voltage; and a resistive network coupled to the input transistor, the resistive network comprising a first resistor, a second resistor and a third resistor coupled in series, the first PTAT voltage generator coupled to a first node of the first resistor and to a second node of the first resistor.

17. The voltage reference circuit of claim 16, further comprising a potential stabilizer coupled to a collector of the input transistor, the potential stabilizer operable to stabilize a potential at the collector of the input transistor.

18. The voltage reference circuit of claim 11, the first PTAT voltage generator comprising a pair of PNP transistors capable of operating at different current densities, and the differential amplifier comprising a pair of NPN transistors capable of operating at different current densities.

19. The voltage reference circuit of claim 11, the first PTAT voltage generator comprising a pair of NPN transistors and the differential amplifier comprising a pair of PNP transistors.

20. A method for generating a reference voltage, comprising:

generating a first PTAT voltage with a first PTAT voltage generator, the first PTAT voltage generator comprising a pair of PNP transistors;

providing the first PTAT voltage to an amplifier comprising a second PTAT voltage generator, the second PTAT voltage generator comprising a pair of NPN transistors;

generating a second PTAT voltage with the second PTAT voltage generator; and generating a reference voltage with the amplifier based on the first PTAT voltage and the second PTAT voltage.

* * * * *

UNITED STATES PATENT AND TRADEMARK OFFICE

CERTIFICATE OF CORRECTION

PATENT NO. : 7,595,627 B1
APPLICATION NO. : 11/900993
DATED : September 29, 2009
INVENTOR(S) : Torsten Mahnke, Stephan Drebinger and Michael Brauer It is certified that error appears in the above-identified patent and that said Letters Patent is hereby corrected as shown below:

Column 6, line 12, delete "mathed" and replace with --matched--.

Signed and Sealed this

Twentieth Day of July, 2010

David J. Kappos

David J. Kappos
*Director of the United States Patent and Trademark Office*